US009365404B2

(12) United States Patent
Zitkovic et al.

(10) Patent No.: US 9,365,404 B2
(45) Date of Patent: Jun. 14, 2016

(54) UNIVERSAL CAPLESS REFUELING FUNNEL

(71) Applicant: Ford Global Technologies, LLC, Dearborn, MI (US)

(72) Inventors: Mike Terrence Zitkovic, Dearborn, MI (US); Brian Thomas Aitken, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 435 days.

(21) Appl. No.: 13/679,587

(22) Filed: Nov. 16, 2012

(65) Prior Publication Data

US 2014/0137985 A1 May 22, 2014

(51) Int. Cl.

| | |
|---|---|
| ***B67C 11/02*** | (2006.01) |
| *B67D 7/00* | (2010.01) |
| *B67D 7/02* | (2010.01) |

(52) U.S. Cl.

CPC . *B67C 11/02* (2013.01); *B67D 7/00* (2013.01); *B67D 7/02* (2013.01)

(58) Field of Classification Search

CPC .. B67C 11/00; B67C 11/02; B67C 2011/022; B67C 2011/027; B67C 2011/20; B67D 7/00; B67D 7/02; B60K 2015/0483

USPC ..... 141/331–345, 348–350; 222/566–574

See application file for complete search history.

(56) References Cited

U.S. PATENT DOCUMENTS 474,036 A * 5/1892 Wood ..... 141/340
1,420,011 A * 6/1922 Abbott ..... 141/338
1,420,039 A * 6/1922 Horstkotte ..... 141/338
1,733,261 A * 10/1929 Higby et al. ..... 141/337
1,791,826 A * 2/1931 Middleton ..... A47J 43/288 141/340
3,927,703 A * 12/1975 Beaubien ..... 141/333
4,804,026 A * 2/1989 Bailey ..... 141/340
5,078,189 A * 1/1992 Ronsonet ..... 141/337
5,123,461 A * 6/1992 Belokin et al. ..... 141/98

(Continued)

FOREIGN PATENT DOCUMENTS

DE 102009049482 A1 * 6/2011
ES 2 303 463 * 8/2008

OTHER PUBLICATIONS

Aitken, Brian Thomas, "Refuling Adapter," U.S. Appl. No. 13/756,318, filed Jan. 31, 2013, 20 pages.

(Continued)

*Primary Examiner* — Mark A Laurenzi
*Assistant Examiner* — Andrew StClair
(74) *Attorney, Agent, or Firm* — Julia Voutyras; Alleman Hall McCoy Russell & Tuttle LLP

(57) ABSTRACT

A universal refueling funnel for a capless refueling system is provided. In one example approach the refueling funnel comprises a funnel body with a first opening at a first end and a second opening at a second end opposing the first end, the first opening larger than the second opening, and cross-sections of the funnel body decreasing from the first end towards the second end; and at least two opposing tabs at the second end, the opposing tabs deformable from a first position to a second position, a distance between outer surfaces of the opposing tabs at the second end being a first amount in the first position, the distance being a second, smaller amount, in the second position. Such a universal funnel may be used for both petrol and diesel size capless inserts, for example.

18 Claims, 11 Drawing Sheets

(56) References Cited

U.S. PATENT DOCUMENTS

| | | | | |
|---|---|---|---|---|
| 5,323,963 | A | 6/1994 | Ballu | |
| 5,865,217 | A | 2/1999 | Giacomelli et al. | |
| 5,899,246 | A * | 5/1999 | Cummins et al. | 141/297 |
| 5,980,553 | A | 11/1999 | Gray et al. | |
| 6,035,908 | A * | 3/2000 | Hoffmann | 141/331 |
| D422,674 | S * | 4/2000 | Chrisco et al. | D23/200 |
| 6,135,518 | A * | 10/2000 | Holthaus | 294/214 |
| 6,152,913 | A | 11/2000 | Feith et al. | |
| 6,260,590 | B1 * | 7/2001 | Ziegmann | 141/332 |
| 6,340,038 | B1 * | 1/2002 | Ingram | 141/333 |
| 6,367,724 | B1 | 4/2002 | Atkinson et al. | |
| 6,629,979 | B1 | 10/2003 | Feingold et al. | |
| D499,180 | S * | 11/2004 | Best | D24/122 |
| 7,299,834 | B1 * | 11/2007 | Platt | 141/344 |
| 7,879,009 | B1 | 2/2011 | Haddock et al. | |
| 7,886,782 | B1 * | 2/2011 | Curtis | 141/338 |
| 2003/0106608 | A1 * | 6/2003 | Walter et al. | 141/331 |
| 2005/0113804 | A1 * | 5/2005 | von Lehe et al. | 604/528 |
| 2011/0186622 | A1 * | 8/2011 | Nikon | 232/15 |
| 2012/0090724 | A1 * | 4/2012 | Heller | 141/1 |
| 2012/0305125 | A1 * | 12/2012 | Nirmel | 141/1 |
| 2013/0019995 | A1 * | 1/2013 | Muse | 141/340 |
| 2013/0319572 | A1 * | 12/2013 | Zweifel | B67D 7/42 141/1 |
| 2014/0209209 | A1 * | 7/2014 | Aitken | B67D 7/42 141/311 R |
| 2015/0298384 | A1 * | 10/2015 | McKenzie | B29C 49/04 141/1 |

OTHER PUBLICATIONS

Anonymous, "Method to reduce fuel volatility in PHEV vehicles to improve Evap monitor robustness and emissions," IPCOM No. IPCOM000238130D, Published Aug. 4, 2014, 2 pages.

Anonymous, "A Method to Wakeup PCM During Refueling Event," IPCOM No. 000240456, Published Jan. 30, 2015, 2 pages.

* cited by examiner

UNIVERSAL CAPLESS REFUELING FUNNEL

BACKGROUND AND SUMMARY

Fuel systems for engines, e.g., diesel or petrol/gasoline engines, may include capless fuel filler necks on a fuel filler pipe coupled to a fuel tank for replenishing fuel in the tank. Such capless fuel filler necks may include sealing doors which remain closed to seal off the fuel system without a cap. A sealing door on a capless fuel filler neck may be opened by inserting a fuel nozzle into the fuel filler neck for refueling, for example.

Such capless fuel filler necks may further be designed to reduce mis-fueling. For example, a capless fuel filler neck may include a mis-fueling inhibitor (MFI) to reduce occurrences of customer mis-fuelings wherein a customer accidentally uses the wrong fuel type for an engine. Such mis-fueling inhibitors may be designed to prevent incorrectly-sized fuel nozzles or spouts from opening a sealing door on a capless fuel filler neck in order to reduce occurrences of mis-fueling. For example, in a diesel engine, a mis-fueling inhibitor may be configured to permit a standard-sized diesel fuel nozzle to open the capless filler neck and prevent a petrol fuel nozzle, which may be smaller than a diesel fuel nozzle, from opening the capless filler neck. As another example, in a petrol engine, a mis-fueling inhibitor may be configured to permit a standard-sized petrol fuel nozzle to open the capless filler neck and prevent a diesel fuel nozzle from opening the capless filler neck.

However, during some conditions, customers may need to open the capless refueling device to use a portable refueling can to add fuel to their vehicle or to refuel with a pump nozzle that is an incorrect size for the capless MFI installed on their vehicle. Thus, in some examples, a capless refueling funnel, e.g., a supplemental refueling adapter (SRA), may be provided to the customer so that the customer can refuel the fuel tank in absence of a correctly-sized refueling nozzle. Such capless refueling funnels may be special funnels with the correct nozzle diameter at the tip provided to the customer in their vehicle for the type of fuel that their vehicle accepts, e.g., petrol or diesel.

The inventors herein have recognized that when installing such refueling funnels on an assembly line which runs different types of vehicles which use different fuel types and thus different refueling funnel sizes, there may be occurrences of including incorrectly sized refueling funnels on vehicles. For example, in assembly lines which run both petrol and diesel vehicles, two differently sized funnels may be available to be included in a vehicle, one for petrol vehicles, and one for diesel vehicles. For example, the only difference between a diesel refueling funnel and a petrol refueling funnel may be at the tips of the funnels which have different diameters to open the correct capless MFI. This causes problems trying to make sure the correct size funnel is installed on the assembly line which may run both petrol and diesel vehicles concurrently. In some approaches, to reduce mistakes, error proofing labels with barcodes may be applied to each funnel so that they can be scanned and verified before installing into each vehicle. The labels, application to the funnel, scanners, time required to scan by operator, and complexity in the plant, increase cost to the vehicle manufacturer.

In one example approach, in order to address these issues, a capless refueling adapter is provided. The capless refueling adapter comprises a funnel body with a first opening at a first end and a second opening at a second end opposing the first end, the first opening larger than the second opening, and cross-sections of the funnel body decreasing from the first end towards the second end; and at least two opposing tabs at the second end, the opposing tabs deformable from a first position to a second position, a distance between outer surfaces of the opposing tabs at the second end being a first amount in the first position, the distance being a second, smaller amount, in the second position.

In this way, one design of a refueling funnel may be used to fit capless refueling necks with differently sized mis-fueling inhibitors. For example, a single refueling funnel may be used for both diesel and petrol vehicles. In such an approach, occurrences of installing the wrong funnel in the wrong vehicle on an assembly line may be reduced. Further, costs associated with funnel labeling, scanning, and other costs associated with determining a correct funnel for a vehicle on an assembly line may be reduced since such labels and scanning may not be needed to determine a correct funnel for a vehicle. As such, a customer in their time of need, e.g., when they run out of fuel by the side of the road, may be assured of having a correct refueling funnel installed in their vehicle for refueling.

It should be understood that the background and summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
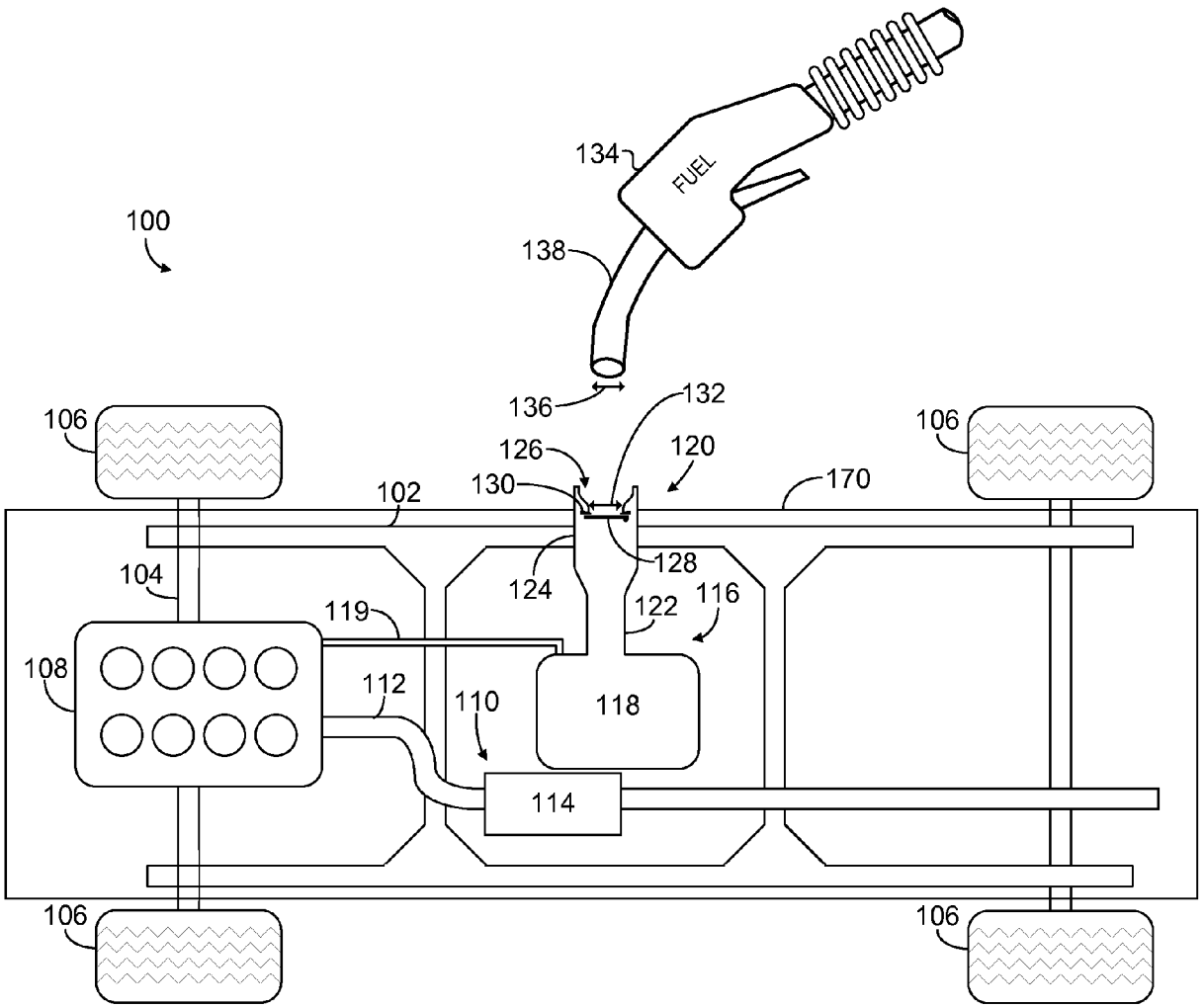
FIG. 1 shows a schematic depiction of an example vehicle system with a capless fuel filler system in accordance with the disclosure.
Figure 2:
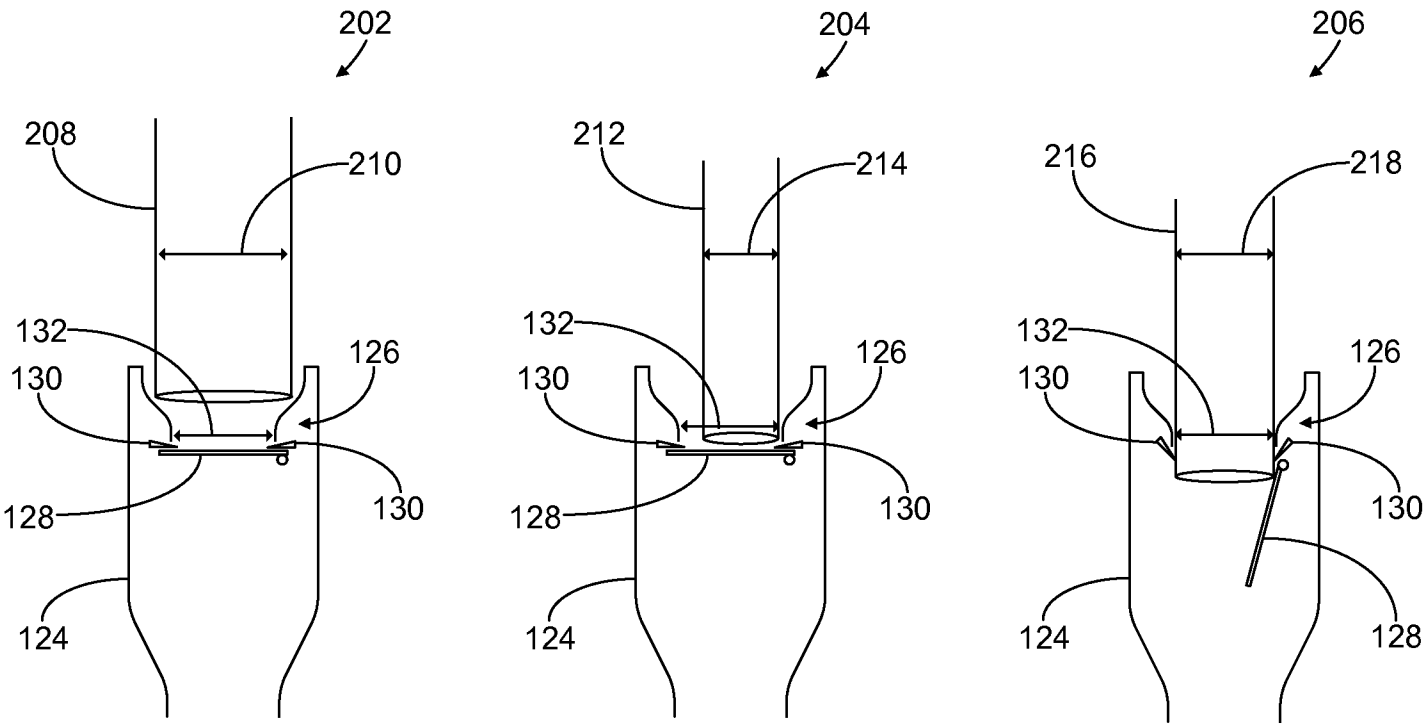
FIG. 2 shows example mis-fueling inhibitors in accordance with the disclosure.
Figure 3:
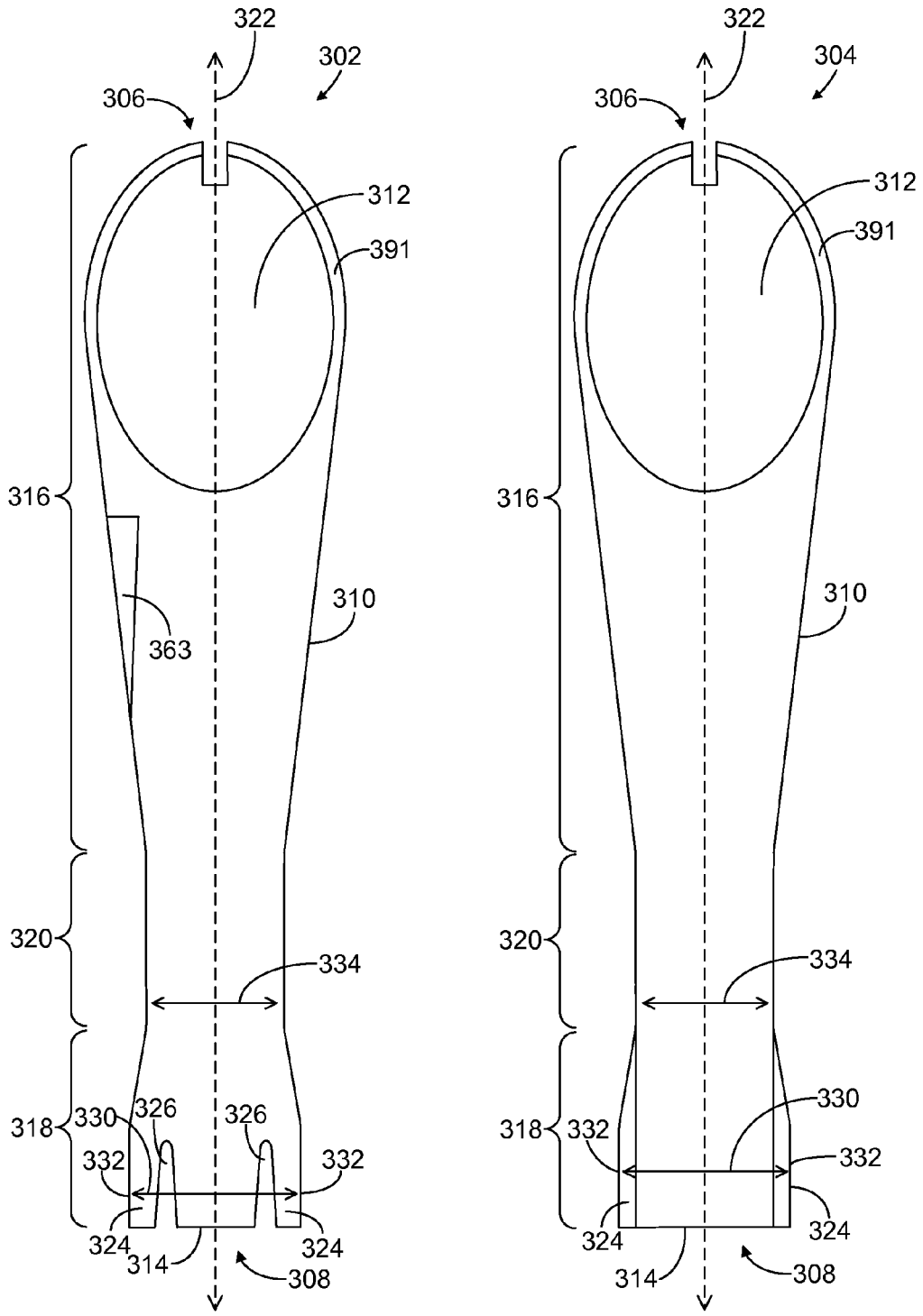
FIGS. 3-4 show example refueling funnels in accordance with the disclosure.
Figure 4:
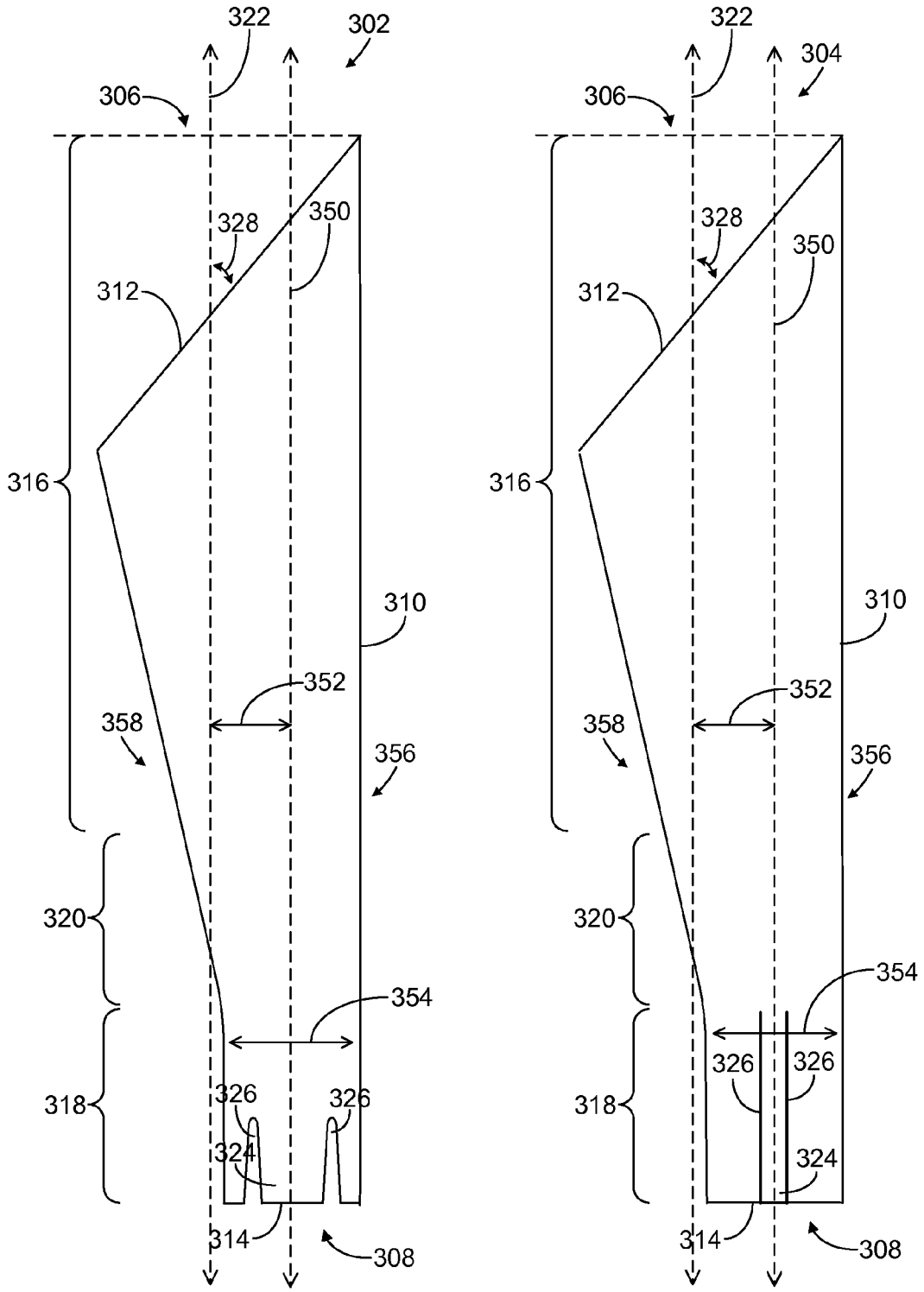

The following description relates to a universal capless refueling funnel or adapter which may be included in a vehicle, e.g., the vehicle shown in FIG. 1. For example, a single type of universal capless refueling funnel may be included in both diesel and petrol vehicles and may be installed in such vehicles on an assembly line. As shown in FIG. 2, mis-fueling inhibitors may be configured to prevent incorrectly-sized fuel nozzles or spouts from opening a sealing door on a capless fuel filler neck in order to reduce occurrences of mis-fueling. A universal capless refueling funnel, such as shown in FIGS. 3-4, may be included in a vehicle so that a customer can refuel the fuel tank in absence of a refueling nozzle sized to fit the mis-fueling inhibiter. A single type of universal refueling funnel may be coupled with differently sized mis-fueling inhibitors. For example, a universal refueling funnel may be configured to couple with both a petrol and a diesel mis-fueling inhibitor, as shown for example in FIG. 5. A universal capless refueling funnel includes a tip, such as the example tips shown in FIGS. 6-10, which is configured to rigidly adapt to differently sized mis-fueling inhibitors. For example, a universal capless refueling funnel tip may be configured to rigidly adapt to a first position sized to fit a diesel mis-fueling inhibiter and a second position sized to fit a diesel mis-fueling inhibiter.

Turning to FIG. 1, a schematic depiction of an example vehicle system is shown generally at 100. Vehicle 100 may include a chassis 102, an axle 104 with wheels 106, and an engine 108. The engine 108 may be a diesel engine in one example or a petrol or gasoline engine in other examples. Further, although not shown, vehicle 100 may further include a transmission, cab, or other components.

Vehicle 100 may further include an exhaust system 108. The exhaust system may include an exhaust conduit 112 leading to one or more exhaust aftertreatment devices, e.g., devices 114. Portions of the exhaust system, such as conduit 112, may be coupled to an exhaust manifold of engine 108 to that exhaust gas is supplied from the exhaust manifold to the conduit 112.

Vehicle 100 may further include a fuel system 116. Fuel system 116 may include one or more fuel storage tanks 118 for storing fuel on-board the vehicle. For example, fuel tank 118 may store one or more liquid fuels, including but not limited to: gasoline, diesel, alcohol fuels, or blends thereof. Fuel tank 118 may be coupled to engine 108 via a fuel delivery line 119 to deliver fuel to engine 108.

A fuel filler pipe 122 may be coupled to fuel tank 118 to direct fuel into fuel tank 118 during refueling. A capless fuel filler system 120 may be coupled to filler pipe 122. As described in more detail below, a capless fuel filler system may include a sealing element which remains closed to seal off the fuel system without a cap. A sealing element in a capless fuel filler system may be opened by inserting a fuel nozzle, such as nozzle 138 of fuel dispensing device 134, into the fuel filler neck 124 for refueling, for example.

Thus, capless fuel filler system 120 includes a capless fuel filler neck 124 which includes a mis-fueling inhibitor 126 including a sealing door 128 held in place by one or more latches 130 which remain closed to seal off the fuel system without a fuel cap. Fuel filler neck 124 may at least partially penetrate an outer surface 170 of vehicle 100 so that fuel may be replenished into the fuel tank via an external fuel source. For example, fuel may be replenished in fuel tank 118 via fuel dispensing device 134 at a refueling pump station.

Mis-fueling inhibitor 126 may be sized to prevent incorrectly-sized fuel nozzles or spouts from opening the sealing door 128 in the capless fuel filler neck in order to reduce occurrences of mis-fueling. The sealing door 128 in the capless fuel filler neck 124 may be opened by inserting a fuel nozzle 138 of a fuel dispensing device 134 into the fuel filler neck 124 for refueling, for example. Such mis-fueling inhibitors may be designed to prevent incorrectly-sized fuel nozzles or spouts from opening a sealing door on a capless fuel filler neck in order to reduce occurrences of mis-fueling. For example, in a diesel engine, a mis-fueling inhibitor may be configured to permit a standard-sized diesel fuel nozzle to open the capless filler neck and prevent a petrol fuel nozzle, which may be smaller than a diesel fuel nozzle, from opening the capless filler neck. As another example, in a petrol engine, a mis-fueling inhibitor may be configured to permit a standard-sized petrol fuel nozzle to open the capless filler neck and prevent a diesel fuel nozzle from opening the capless filler neck.

For example, a diameter 132 of mis-fueling inhibitor 126 may be sized to receive a fuel nozzle associated with a specific type of fuel, e.g., diesel or petrol, used by engine 108. Thus, when a diameter 136 of fuel nozzle 138 is substantially the same size as the diameter 132 of the mis-fueling inhibitor, the nozzle 138 may cause the sealing door to unlatch and open when inserted into fuel filler neck 124. However, when a diameter of a fuel nozzle is different from diameter 132, the sealing door 128 may remain closed thus preventing mis-fueling.

For example, FIG. 2 shows an example fuel filler neck 124 with a mis-fueling inhibitor 126 interfacing with fuel nozzles of different sizes. For example, at 202, FIG. 2 shows a fuel nozzle 208 with a first diameter 210 interfacing with mis-fueling inhibitor 126 where the mis-fueling inhibitor has an opening size 132 which is less than diameter 210 of nozzle 208. For example, mis-fueling inhibitor 126 may be sized to receive a standard sized petrol fuel nozzle and nozzle 208 may be a diesel fuel nozzle with a larger diameter than a petrol fuel nozzle. In this example, since diameter 210 of nozzle 208 is larger than the opening in the mis-fueling inhibitor, nozzle 208 may be prevented from entering the opening in mis-fueling inhibitor 126 so that mis-fueling is prevented.

At 204, FIG. 2 shows a fuel nozzle 212 with a second diameter 214 interfacing with mis-fueling inhibitor 126. In this example, diameter 214 is less than the opening size 132 in mis-fueling inhibitor 126. For example, mis-fueling inhibitor may be sized to receive a standard sized diesel fuel nozzle whereas nozzle 212 may be a petrol fuel nozzle with a diameter smaller than the diameter of a standard sized diesel fuel nozzle. In this example, since diameter 214 is less than the opening size 132 of mis-fueling inhibitor 126, nozzle 212 may not be able to unlatch both of the latches 130 adjacent to sealing door 128 so that sealing door 128 remains closed and nozzle 212 is prevented from opening sealing door 128. In this way, mis-fueling is prevented when the diameter of the fuel nozzle is too small.

At 206, FIG. 2 shows another fuel nozzle 216 with a third diameter 218 interfacing with mis-fueling inhibitor 126. In this example, fuel nozzle 216 is a correct size to unlatch and open sealing door 128 for refueling. For example, diameter 218 may be substantially the same size as the opening size 132 of mis-fueling inhibitor 126 so that nozzle 216 unlatches both latches 130 adjacent to sealing door 128 to open sealing door 128 when inserted into mis-fueling inhibitor 126. For example, mis-fueling inhibitor 126 may be sized to receive a standard sized petrol fuel nozzle and nozzle 216 may be a petrol nozzle. As another example, mis-fueling inhibitor 216 may be sized to receive a standard sized diesel fuel nozzle and nozzle 216 may be a diesel nozzle.

As remarked above, during some conditions, customers may need to open a capless refueling device, such as capless refueling system 120, to use a portable refueling can or other fuel source to add fuel to their vehicle or to refuel with a pump nozzle that is an incorrect size for the capless MFI installed on their vehicle. Thus, in some examples, a capless refueling funnel, e.g., a supplemental refueling adapter (SRA), may be provided to the customer so that the customer can refuel the fuel tank in absence of a correctly-sized refueling nozzle. Such capless refueling funnels may be special funnels with the correct nozzle diameter at the tip provided to the customer in their vehicle for the type of fuel that their vehicle accepts, e.g., petrol or diesel.

A single universal refueling funnel may be designed to fit capless refueling necks with differently sized mis-fueling inhibitors. For example, a single refueling funnel may be used for both diesel and petrol vehicles. Such funnels may include a tip which is configured to rigidly adapt or conform to two or more mis-fueling inhibitor sizes so that the funnel can be used to provide access to different capless refueling systems coupled to vehicles with different fuel requirements.

For example, FIGS. 3-4 show two examples of a universal refueling funnel from different perspectives. FIG. 3 shows a first example universal refueling funnel 302 and a second example universal refueling funnel 304 from a top view and FIG. 4 shows the first example universal refueling funnel 302 and the second example universal refueling funnel 304 from a side view.

Each of the example universal refueling funnels shown in FIGS. 3-4 comprise a funnel body 310 with a first opening 312 at a first end 306 and a second opening 314 at a second end 308, where the first opening 312 is larger than the second opening 314. For example, a size of first opening 312, e.g., a diameter of the first opening, may be at least twice as large as a size of second opening 314, e.g., a diameter of the second opening, to accommodate different fuel sources. For example, the first opening 312 in the first end 306 may be sized to receive nozzles from a variety of refueling devices such as refueling cans, pump nozzles, or other non-standard fuel sources. The second end 308 of the refueling funnel may be inserted into a capless refueling system, such as capless refueling system 120, to unlatch and/or open the capless refueling system so that a fuel tank may be refueled with a non-standard or incorrectly sized fuel nozzle or other fuel source.

The walls 391 of funnel body 310 may be composed of a plastic material. For example, the funnel body may be formed from injection molded tooling and may be at least partially deformable at some portions of the body. For example, a tip section 318 of the funnel may be at least partially deformable as described in more detail below. Further, in some examples, as shown at 302 in FIG. 3, a funnel may include human readable vehicle operating instructions 363 for refueling a vehicle with the refueling funnel. For example, the instructions 363 may be printed or engraved onto a surface of the funnel in any suitable manner. As another example, instructions may be printed on an adhesive material and then attached to the funnel. However, in some examples, human readable vehicle operating instructions for refueling a vehicle with the refueling funnel may be included in a user manual or other source provided with the vehicle and may be separate from the body of the funnel.

As shown in the top views of FIG. 3, the funnel body 310 includes a first central axis 322 extending through the center of first funnel opening 312 through the funnel body along a direction between first end 306 and second end 308. As shown in the side views of FIG. 4, the funnel body includes a second central axis 350 extending through the center of the second funnel opening 314 at the second end 308 through the funnel body along a direction between first end 306 and second end 308. The second central axis 350 may be offset from the first central axis 322 by a distance 352 so that the center of second opening 314 is offset from the center of the first opening 312.

The funnel body 310 may have circular, elliptical, or oval cross-sections throughout the funnel body in some examples. However, in other examples, the funnel body may have any other suitable cross sections throughout the body to direct fuel from a fuel source provided at first opening 312 into a capless refueling system via second opening 314. For example, the funnels shown in FIGS. 3 and 4 have oval or elliptical cross sections throughout the funnel body. As shown in the top views of FIG. 3, the elliptical cross sections of the funnel body each have a transverse diameter 334 along the major axis of the elliptical cross section which may vary through the funnel body. Further, as shown in the side view of FIG. 4, the elliptical cross sections of the funnel body each have a conjugate diameter 354 along the minor axis of the elliptical cross section which may vary through the funnel body. Further, as described below, the conjugate diameters and transverse diameters of the elliptical cross sections of the funnel may vary differently throughout the funnel body.

Funnel body 310 may comprise three different portions: a funnel portion 316 adjacent to first end 306, a tip 318 adjacent to second end 308, and a central portion 320 between funnel portion 316 and tip 318. In some examples, cross-sectional areas of each section of the funnel body may be circular or oval-shaped. However, in other examples, cross-sectional areas of the funnel body may vary. For example, cross-sectional areas of the funnel body along the funnel section 316 may be oval-shaped, cross-sectional areas of the central portion 320 may be circular shaped, and cross-sectional areas of the tip 318 may be oval shaped. However, it should be understand that any suitable cross-sections throughout the funnel body may be used.

As remarked above, the example funnels shown in FIGS. 3 and 4 have elliptical cross sections throughout the funnel body. In some examples, a universal funnel may have only elliptical cross sections throughout the funnel. However, in other examples, certain portions, such as a funnel and central portion, may only have elliptical cross sections throughout whereas a tip portion may have a circular cross section throughout. Sizes of cross-sections, e.g., conjugate diameters and transverse diameters of elliptical cross-sections, of the funnel body, may decrease from the first end 306 to central portion 320 of the funnel body in a direction from the first end 306 towards the second end 308. For example, diameters of cross-sections in the funnel portion 316 may decrease in a direction from first opening 312 to central portion 320 to create a funnel shape for directing fuel from first opening 312 toward second opening 314 when the funnel is coupled to a capless refueling device.

In some examples, cross-sections of the funnel body in the central portion 320 may be substantially the same. For example, cross-sectional areas in the central portion may be circular and diameters of the circular cross sections throughout the central portion may be substantially the same throughout the central portion. However, in other examples, cross sections of the funnel body in the central portion may vary, e.g., cross-sections may decrease in a direction from the funnel portion 316 towards the tip 318 in order to extend the funnel shape of funnel portion 316.

For example, as shown in the top views of FIG. 3, transverse diameters 334 of elliptical cross sections may be substantially the same throughout the central portion 320, whereas conjugate diameters 354 of the elliptical cross sections may decrease in central portion 320 in a direction from the funnel section 316 toward tip 318 as shown in FIG. 4. In this way, as shown in the side views in FIG. 4, a bottom side 356 of the funnel may be substantially straight from the first opening 312 to the second opening 314 whereas a top side 358 of the funnel may be graduated and/or curved from the first opening 312 to the top 318 so that a funnel shape is formed by the funnel section 316 and the central section 320 in a side view of the funnel.

In some examples, the first opening 312 of the funnel may be angled into the funnel body. For example, as shown in FIG. 4, first opening 312 may form an angle 328 relative to central axis 322 of funnel body 310. For example, angle 328 may be approximately 45 degrees. However, any suitable angle may be used, e.g., any angle less than or equal to 90 degrees relative to central axis 322. By angling the first opening into the funnel body, a greater variety of fuel sources may be used to direct fuel into the funnel towards second end 308 for replenishing fuel in a capless refueling system. For example, when the tip 318 of the universal funnel is coupled to a capless refueling system, a customer may pour fuel into the angled opening 312. The fuel provided by the customer at angled opening 312 may then be directed by the funnel toward tip 318 and into a filler neck of the capless refueling device.

Tip 318 of funnel body 310 may be designed in a variety of ways and may be configured to rigidly adapt to two or more configurations sized to fit two or more mis-fueling inhibitors of different sizes. For example, tip 318 may include a variety of deformable features which may deform upon insertion into a capless refueling system to a size suitable for unlatching and opening a sealing door in the mis-fueling inhibitor of the capless refueling system.

For example, tip 318 may include at least two opposing tabs 324 at the second end 308. A distance 330 between outer surfaces 332 of the opposing tabs 324 may decrease in a direction from the second end 308 toward the central portion 320. For example, distance 330 between outer surfaces 332 of the opposing tabs 324 may decrease to a distance corresponding to a diameter 334 of central portion 320. In this example, the distance 330 between outer surfaces 332 of the opposing tabs 324 may be substantially the same size as an opening in a first mis-fueling inhibitor, e.g., a mis-fueling inhibitor used for a diesel fuel tank, whereas the diameter of the central portion 320 may be substantially the same size as a second mis-fueling inhibitor, e.g., a mis-fueling inhibitor used for a petrol or gasoline fuel tank. Thus, in an extended position, the tabs 324 may accommodate the diesel mis-fueling inhibitor so that the distance between outer surfaces of the opposing tabs is substantially the same size as a standard diesel fuel nozzle, e.g., 1 inch. However, in a deformed position, where the tabs are bent toward an interior of the funnel body, the tip 318 may fit within a petrol mis-fueling inhibitor so that distance between outer surfaces of the opposing tabs is substantially the same size as a standard petrol fuel nozzle, e.g., ¾ inch.

In some examples, such as funnel 302 shown in FIGS. 3 and 4, tip 318 may have an elliptical cross section where the distance 330 between outer surfaces 332 of the opposing tabs 324 corresponds to a transverse diameter of the elliptical cross section of tip 318. As shown in FIG. 3, transverse diameters 330 of elliptical cross sections of tip 318 of funnel 302 may decrease in a direction from second end 308 towards central portion 320. However, as shown in FIG. 4, conjugate diameters 254 of elliptical cross sections of tip 318 in funnel 302 may remain substantially the same length throughout tip 318 of funnel 302. For example, conjugate diameters 254 of elliptical cross sections of tip 318 in funnel 302 may be substantially the same size as a diameter of an opening in a petrol or gasoline mis-fueling inhibitor whereas transverse diameters 330 of elliptical cross sections of tip 318 of funnel 302 adjacent to end 308 may be substantially the same size as a diameter of an opening in a diesel mis-fueling inhibitor.

In other examples, such as funnel 304 shown in FIGS. 3 and 4, tip 318 may have substantially circular cross sections throughout the tip and may include opposing tabs 324 extending outside of walls of the funnel at the tip. In this example, a distance 330 between outer surfaces of the opposing tabs may be greater than a diameter of a circular cross section of tip 318 adjacent to second end 308. The distance 330 between outer surfaces of the opposing tabs may decrease in a direction from second end 308 toward central portion 320. In this example, the diameter 354 of the circular cross sections of tip 318 of funnel 304 may be substantially the same size as a diameter of an opening in a petrol or gasoline mis-fueling inhibitor whereas the distance 330 between outer surfaces of the opposing tabs adjacent to end 308 may be substantially the same size as diameter of an opening in a diesel mis-fueling inhibitor.

Each tab in the least two opposing tabs 324 may be separated from a wall of second end 308 by gaps 326 to that the tabs are movable relative to other portions of the second end to assist in deformation of the second end to fit within various mis-fueling inhibitors of varying sizes. In some examples, the gaps 326 may include thin walls disposed therein. For example, a width of a thin wall in a gap may be less than a width of a wall of the second end 308 of the funnel.

For example, the opposing tabs may be deformable from a first position to a second position, wherein in the first position the distance between outer surfaces of the opposing tabs at the second end is a first distance, and wherein in the second position the distance between outer surfaces of the opposing tabs at the second end is a second distance less than the first distance. For example, the first distance may be substantially the same length as a diameter of a diesel filler pipe and the second distance may be substantially the same length as a diameter of a petrol filler pipe.

For example, tip 318 of the example funnel shown at 302 in FIGS. 3-4 includes a crush rib design with multiple tabs 324 separated by gaps in the wall of second end 308 and tip 318 of the example funnel shown at 304 in FIGS. 3-4 includes two opposing tabs 324 extending beyond the walls of the second end 308. These and other example funnel tip sections are described in more detail below with regard to FIGS. 6-10.

Figure 5:
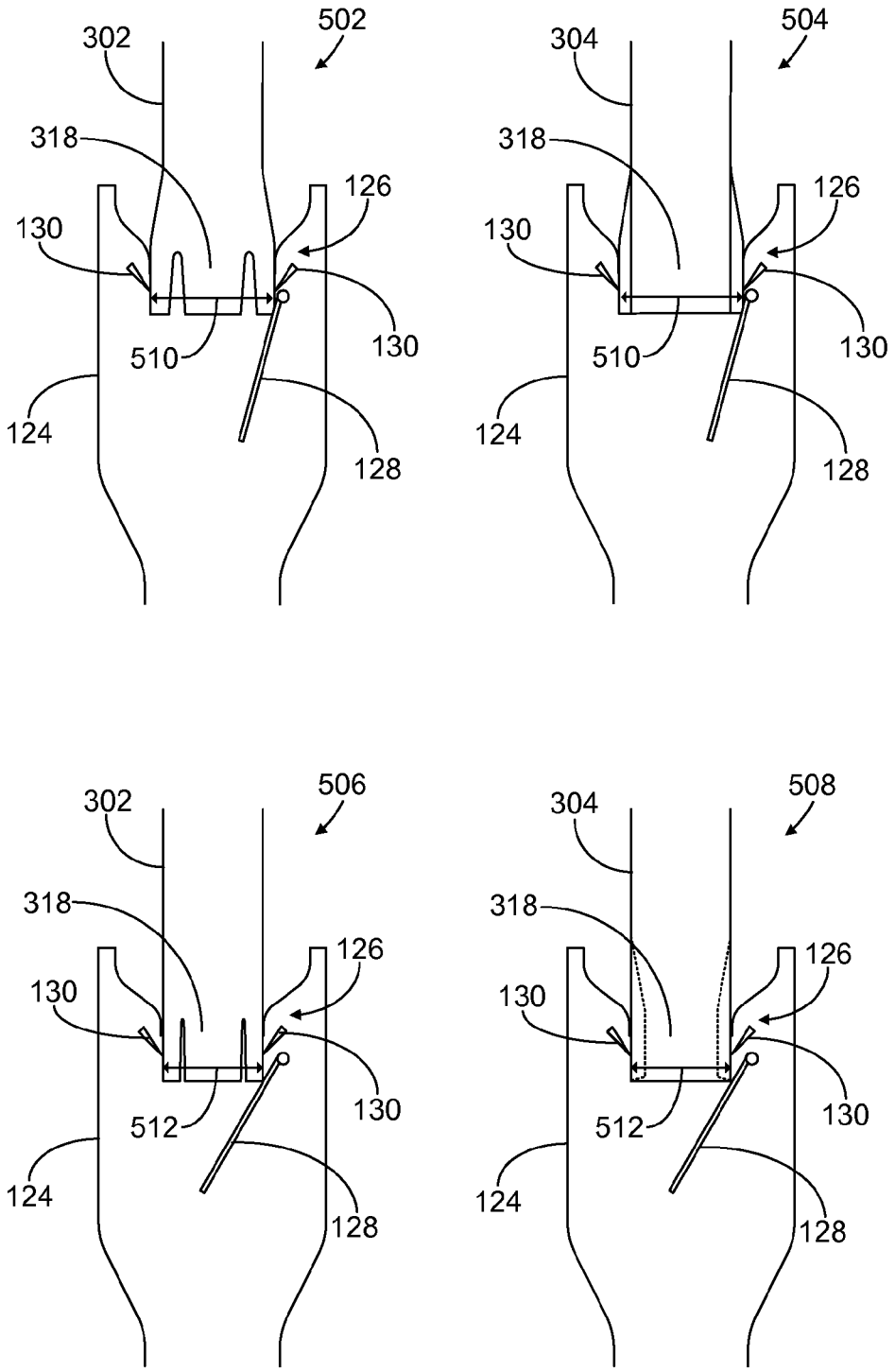
FIG. 5 illustrates example couplings of refueling funnels with capless fuel filler necks in accordance with the disclosure.

As illustrated in FIG. 5, these funnel tip designs are configured to adapt to differently sized mis-fueling inhibitors so that a single refueling funnel may be used in vehicles with differently sized mis-fueling inhibitors corresponding to different vehicle fuel requirements. For example, the funnels shown in FIGS. 3 and 4 may be used in both diesel and petrol vehicles with capless filler pipe systems. In some examples, the tips of universal refueling funnels, such as funnels 302 and 304, may be configured to rigidly adapt to only two different sizes corresponding to two different opening sizes in two different types of mis-fueling inhibitors, e.g., diesel or petrol. However, in other examples, funnel tips may be configured to adapt to a plurality of sizes to accommodate a plurality of different sizes of openings in different types of mis-fueling inhibitors.

At 502, FIG. 5 shows example funnel 302 interfacing with a diesel mis-fueling inhibitor 126 of a fuel filler neck 124 of a fuel tank for a diesel engine. At 504, FIG. 5 shows example funnel 304 interfacing with a diesel mis-fueling inhibitor 126 of a fuel filler neck 124 of a fuel tank for a diesel engine. The mis-fueling inhibitor 126 shown at 502 and 504 in FIG. 5 is sized to receive a standard diesel fuel nozzle. In this example, the tips 318 of funnels 302 and 304 are not deformed but maintain an outer diameter 510 which is substantially the same size as the opening in the diesel mis-fueling inhibitor. As such, the funnel tips fit within the opening in the mis-fueling inhibitor to unlatch the latches 130 to open the sealing door 128 of the diesel capless refueling system. For example, the gaps 326 between tabs 324 in tip 318 of funnel 304 remain in an open or un-deformed position so that the tip 318 is in a first position with diameter 510 corresponding to the diameter of the opening of the diesel mis-fueling inhibitor. At 504, the tabs 324 at tip 318 of funnel 304 remain in an extended and un-deformed position so that the tip 318 is in a first position with diameter 510 corresponding to the diameter of the opening of the diesel mis-fueling inhibitor.

At 506, FIG. 5 shows example funnel 302 interfacing with a petrol mis-fueling inhibitor 126 of a fuel filler neck 124 of a fuel tank for a petrol engine. At 508, FIG. 5 shows example funnel 304 interfacing with a petrol mis-fueling inhibitor 126 of a fuel filler neck 124 of a fuel tank for a petrol engine. The mis-fueling inhibitor 126 shown at 506 and 508 is sized to receive a standard petrol fuel nozzle which may be smaller than a diesel fuel filler nozzle. For example, openings in the mis-fueling inhibitors shown at 506 and 508 may be smaller than openings in mis-fueling inhibitors shown in 502 and 504. Thus, at 506 and 508, the tips 318 of funnels 302 and 304 are shown deformed to a second position with a diameter 512 smaller than diameter 510. For example, the outer diameter 512 of tip 318 in the second, deformed position is substantially the same size as the opening in the petrol mis-fueling inhibitor. As such, the deformed funnel tips fit within the opening in the mis-fueling inhibitor to unlatch the latches 130 to open the sealing door 128 of the petrol capless refueling system. For example, at 506 the gaps 326 between tabs 324 in tip 318 of funnel 304 are adjusted to a closed or partially closed position so that the tip is in a second position with smaller diameter 512 corresponding to the diameter of the opening of the petrol mis-fueling inhibitor. At 508, the tabs 324 at tip 318 of funnel 304 are folded into the interior of the funnel tip, as indicated by the dotted lines, so that the tip is in a second position with a smaller diameter 512 corresponding to the diameter of the opening of the petrol mis-fueling inhibitor.

Figure 6:
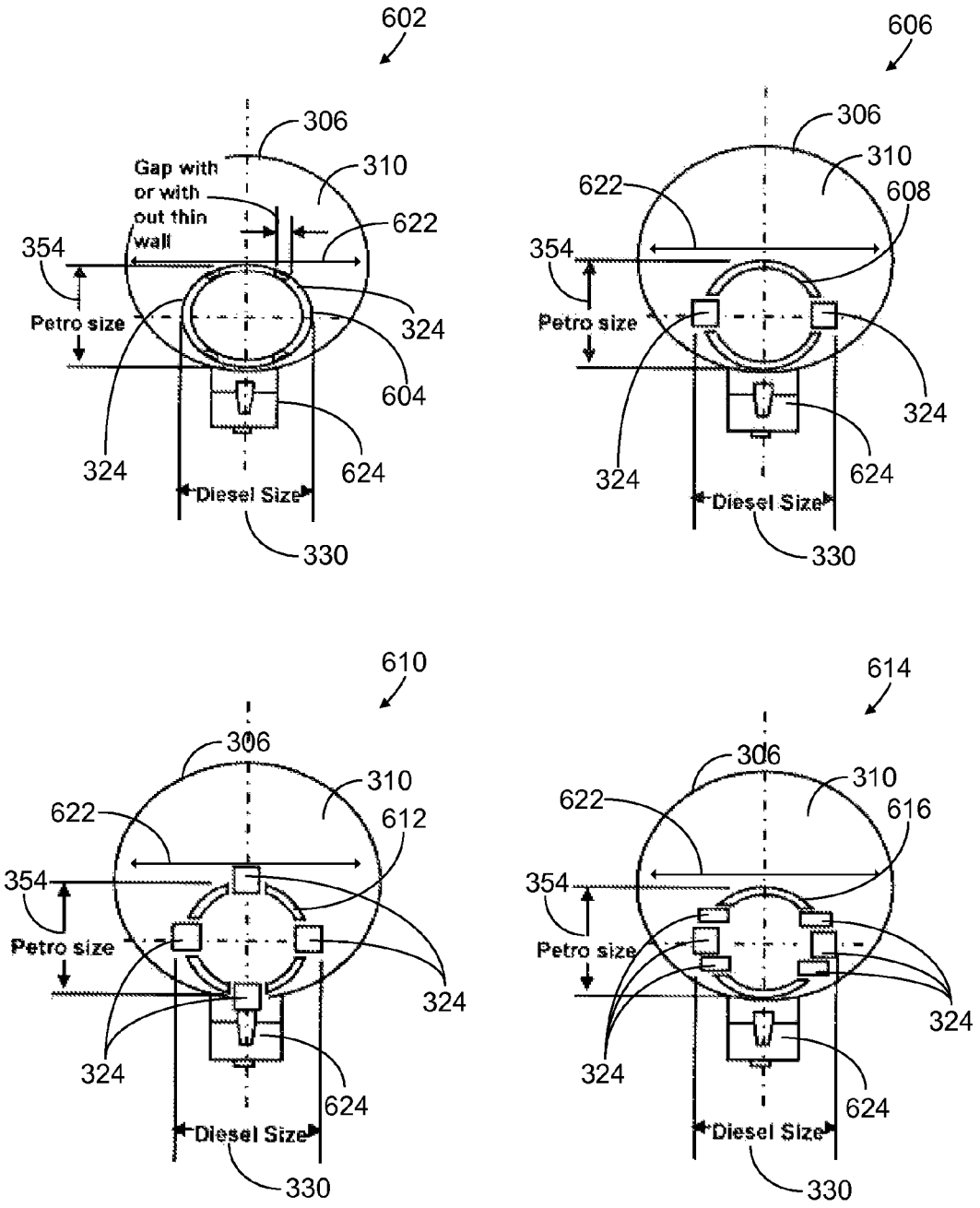
FIGS. 6-10 show example tips of a refueling funnel in accordance with the disclosure.

As remarked above, tips, such as tips 318 shown in FIGS. 3 and 4, of universal refueling funnels may have a variety of configurations for adapting to differently sized mis-fueling inhibitors. For example, FIG. 6 shows example refueling funnels 310 with different tip configurations from the point of view of second end 308 of funnel body 310. In the viewpoints shown in FIG. 6, central axis 322 extends out from the page and the tips of the funnels are shown in the forefront. By way of example, FIG. 6 shows a funnel 310 with a tip configuration 601 at 602, a funnel 310 with a tip configuration 608 at 606, a funnel 310 with a tip configuration 612 at 610, and a funnel 310 with a tip configuration 616 at 614.

As shown in FIG. 6, a diameter 622 of the second opening at second end 308 of the funnel body 310 is larger than diameters of the second opening at the tips. Further, in some examples, as shown in FIG. 6, funnel body may include other features 624 attached thereto. For example, feature 624 may be a clip, e.g., a pen clip, used to stow the funnel in the package space onboard a vehicle. For example, clip 624 could be inserted through a loop, under a strap, or into a plastic holder within a vehicle for storage of the funnel therein.

At 602, funnel body 310 is shown with a tip 604 which includes opposing tabs 324 separated from the walls of the tip by gaps which may or may not include a thin wall as described above. In this example, the cross sectional area of the tip is elliptical with a transverse diameter 330 greater than a conjugate diameter 354. In this example, the transverse diameter 330 is substantially the same size as a diesel fuel nozzle and the conjugate diameter is substantially the same size as a petrol fuel nozzle. Example tip 604 is described in more detail below with regard to FIG. 7.

At 606, funnel body 310 is shown with a tip 608 which includes opposing tabs 324 extending beyond the walls of the tip. In this example, the cross sectional area of the tip is circular with a diameter 354 and the distance 330 between outer surfaces of opposing tabs 324 is greater than diameter 354. In this example, the distance 330 between outer surfaces of opposing tabs 324 is substantially the same length as a diameter of a diesel fuel nozzle and the diameter 354 of the circular cross section of the tip is substantially the same length as a diameter of a petrol fuel nozzle. Example tip 608 is described in more detail below with regard to FIG. 8.

At 610, funnel body 310 is shown with a tip 612 which includes two pairs of opposing tabs 324 extending beyond the walls of the tip. In this example, the cross sectional area of the tip is circular with a diameter 354 and the distance 330 between outer surfaces of the two pairs of opposing tabs 324 is greater than diameter 354. In this example, the distance 330 between outer surfaces of each pair of opposing tabs 324 is substantially the same length as a diameter of a diesel fuel nozzle and the diameter 354 of the circular cross section of the tip is substantially the same size as a diameter of a petrol fuel nozzle. Example tip 612 is described in more detail below with regard to FIG. 9.

At 614, funnel body 310 is shown with a tip 612 which includes multiple pairs of opposing tabs 324 extending beyond the walls of the tip. In this example, the cross sectional area of the tip is circular with a diameter 354 and the distance 330 between outer surfaces of the multiple pairs of opposing tabs 324 is greater than diameter 354. In this example, the distance 330 between outer surfaces of each pair of opposing tabs 324 is substantially the same length as a diameter of a diesel fuel nozzle and the diameter 354 of the circular cross section of the tip is substantially the same size as a diameter of a petrol fuel nozzle. Example tip 614 is described in more detail below with regard to FIG. 10.

Figure 7:
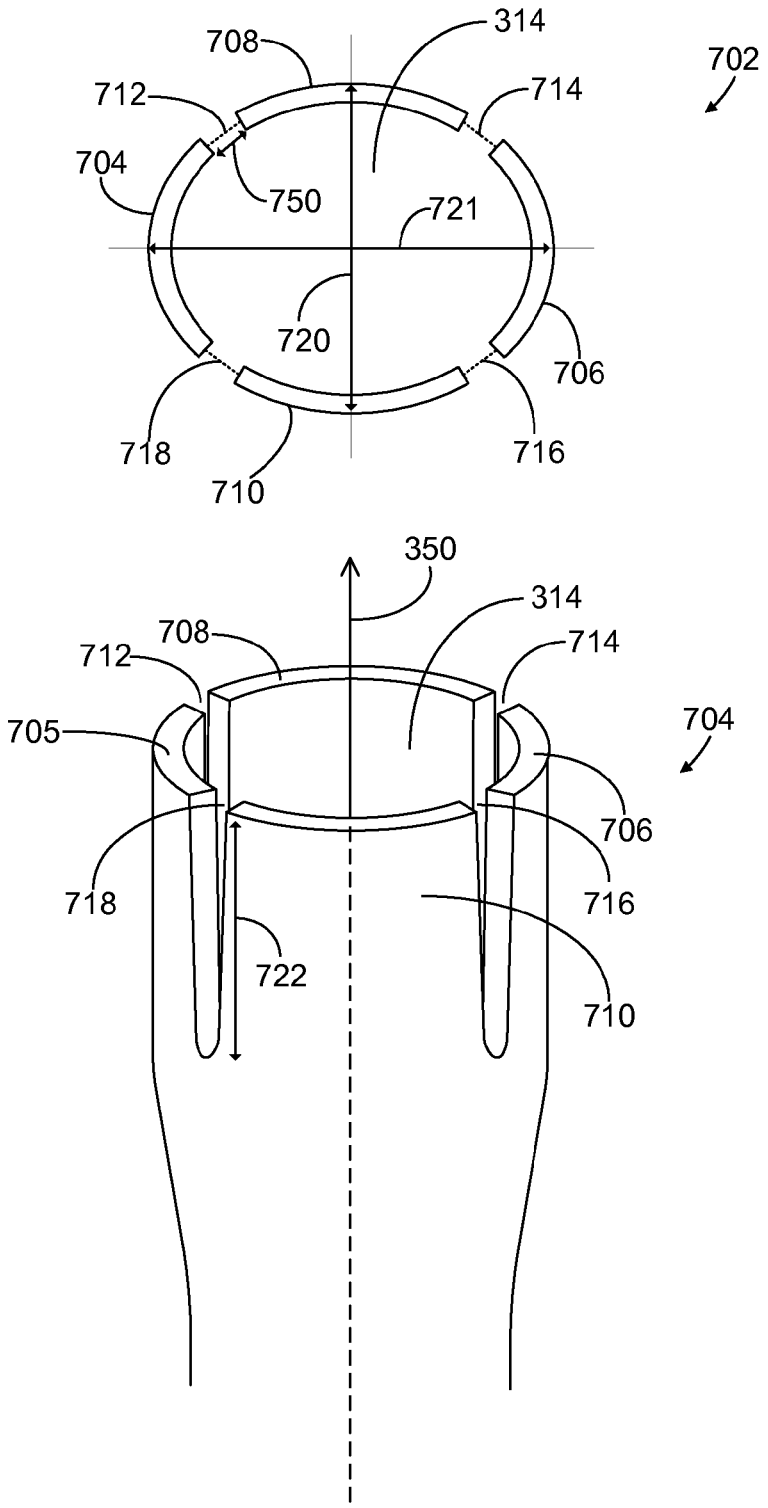

FIG. 7 shows an example tip of a universal refueling funnel from a point of view of second end 308 of funnel body 310 at 702 and from a top view (similar to the top views shown in FIG. 3) at 704. The example funnel tip shown in FIG. 7 corresponds to funnel configuration 604 shown at 602 in FIG. 6 described above.

In the example shown in FIG. 7, a cross section of second opening 314 is elliptical with a transverse diameter 721 and a conjugate diameter 720, where both diameters are measured from opposing outer walls of the funnel tip. In this example, the transverse diameter corresponds to a diameter of an opening of a first type of mis-fueling inhibitor, e.g., a diesel mis-fueling inhibitor, and the conjugate diameter corresponds to a diameter of an opening of a second type of mis-fueling inhibitor, e.g., a petrol mis-fueling inhibitor. For example, transverse diameter 721 may be the same length as a diameter of a standard size diesel fuel nozzle and conjugate diameter may be the same length as a standard size petrol fuel nozzle. Here the conjugate diameter 720 is smaller than the transverse diameter 721.

The refueling funnel tip shown in FIG. 7 includes a pair of opposing tabs 704 and 706 which are separated from walls 708 and 710 of the tip by gaps 712, 718, 716, and 714. In some examples, each gap in the funnel tip may include a thin wall (indicated by dotted lines in the gaps in FIG. 7) extending therethrough where the width of the thin wall is less than the width of walls of the tabs and or walls of the tip.

The gaps separating the tabs from the walls of the tip may extend a distance 722 in a direction from the second opening 314 at second end 308 toward the enlarged first opening 312 along central axis 350 of the second opening 314. Further, as shown in FIG. 7, a width 750 of the gaps may decrease in a direction from the second opening 314 at second end 308 toward the enlarged first opening 312.

The gaps in the funnel tip shown in FIG. 7 permit the funnel tip to deform into two different configurations with different diameters across the second opening so as to fit two differently sized mis-fueling inhibitors. For example, as described above with regard to FIG. 5, in a first extended position, opposing tabs 704 and 706 remain in an open position so that transverse diameter 718 is the same diameter as a diesel fuel nozzle and thus will unlatch and open a sealing door in a mis-fueling inhibitor sized to receive a diesel fuel nozzle.

However, when inserted into a petrol mis-fueling inhibitor, tabs 704 and 706 will deform or bend towards an interior of the fuel funnel tip to a second position so that transverse diameter 718 is decreased to a smaller diameter corresponding to the diameter of a petrol fuel nozzle. In this second position, the funnel tip is deformed to the size of a petrol fuel nozzle and thus will unlatch and open a sealing door in a mis-fueling inhibitor sized to receive a petrol fuel nozzle.

Figure 8:
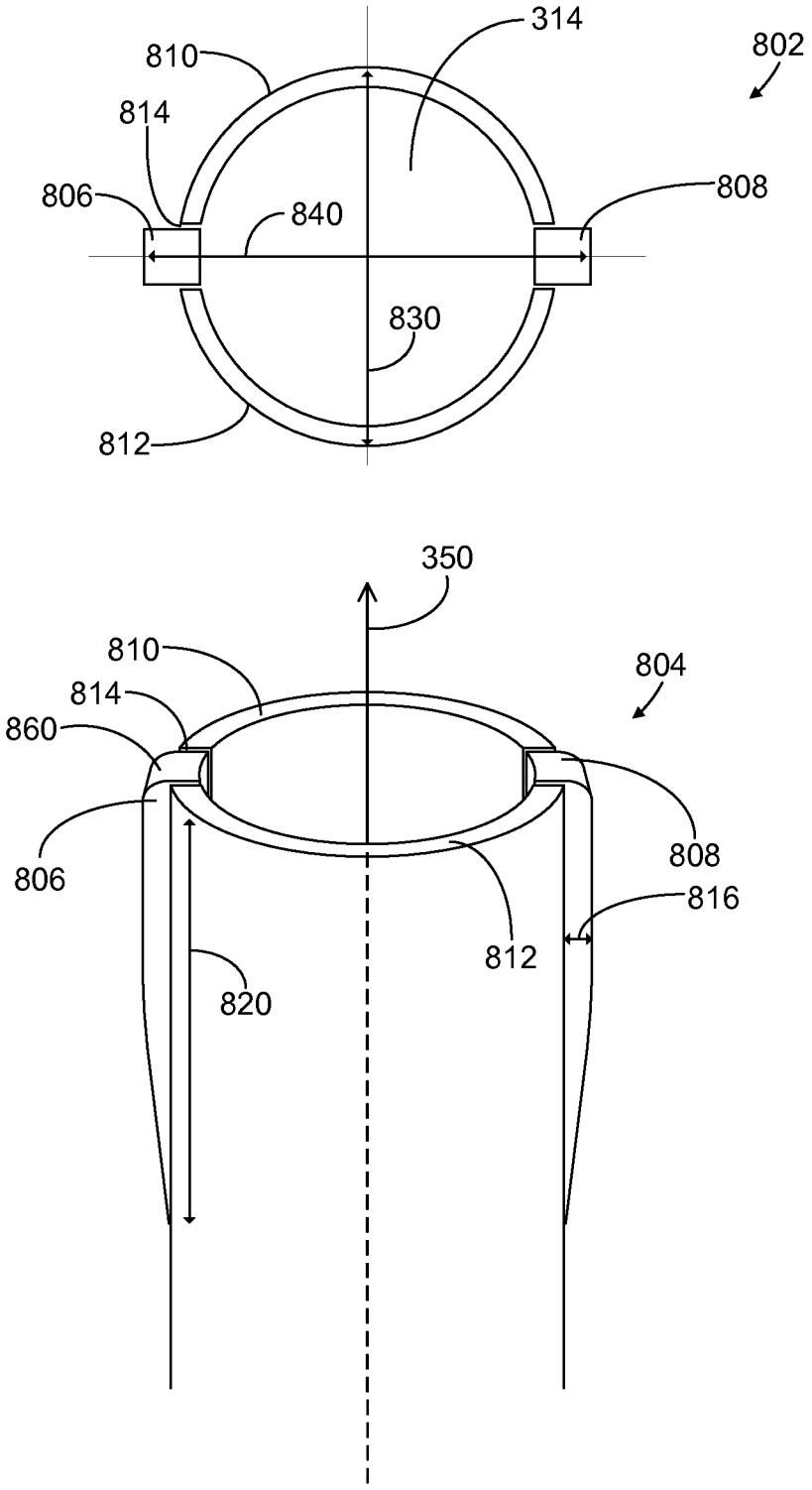

FIG. 8 shows another example tip of a universal refueling funnel from a point of view of second end 308 of funnel body 310 at 802 and from a top view (similar to the top views shown in FIG. 3) at 804. The example funnel tip shown in FIG. 8 corresponds to funnel configuration 608 shown at 606 in FIG. 6 described above.

In the example shown in FIG. 8, a cross section of second opening 314 is circular with a diameter 830 as measured from opposing outer walls of the funnel tip. The funnel tip includes a pair of opposing tabs or fingers 806 and 808 where a distance 840 from outer walls of the opposing tabs is greater than the circular diameter 830. In this example, the distance 840 from outer walls of the opposing tabs corresponds to a diameter of an opening of a first type of mis-fueling inhibitor, e.g., a diesel mis-fueling inhibitor, and the circular diameter 830 corresponds to a diameter of an opening of a second type of mis-fueling inhibitor, e.g., a petrol mis-fueling inhibitor. For example, distance 840 from outer walls of the opposing tabs may be the same length as a diameter of a standard size diesel fuel nozzle and circular diameter 830 may be the same length as a standard size petrol fuel nozzle.

The two opposing tabs 806 and 808 may be separated from walls 810 and 812 by thin gaps, e.g., gap 814, so that the opposing tabs are movable relative to walls 810 and 812. The gaps separating the tabs from the walls of the tip may extend a distance 820 in a direction from the second opening 314 at second end 308 toward the enlarged first opening 312 along central axis 350 of the second opening 314. In this example, a width of the gaps separating the tabs from the walls of the funnel tip may be substantially constant throughout a length of the gap.

The opposing tabs may have a variety of shapes. For example, as shown in FIG. 8, outer edges 860 of the tabs adjacent to second end 308 at opening 314 may be rounded so that when the funnel tip is inserted into an orifice, the tabs will be pushed inward toward an interior of the funnel tip to decrease the distance 840 between outer walls of the opposing tabs. Further, the distance between outer walls of the opposing tabs may decrease in a direction from second end 308 at opening 314 towards the first end 306. For example, as shown in FIG. 8, the tabs may extend a distance 816 beyond the outer walls of funnel walls 810 and 812. This extension distance 816 may decrease to zero in a direction from second end 308 toward first end 306 along central axis 350 of second opening 314.

These flexible tabs in the funnel tip shown in FIG. 8 permit the funnel tip to deform into two different configurations with different diameters across the second opening so as to fit two differently sized mis-fueling inhibitors. For example, as described above with regard to FIG. 5, in a first extended position, opposing tabs 806 and 808 remain in an open, extended position beyond walls 810 and 812 so that the distance 840 between outer walls of the opposing tabs is the same diameter as a diesel fuel nozzle and thus will unlatch and open a sealing door in a mis-fueling inhibitor sized to receive a diesel fuel nozzle. However, when inserted into a petrol mis-fueling inhibitor, tabs 806 and 808 will deform or bend towards an interior of the fuel funnel tip to a second position so that the distance 840 between outer walls of the opposing tabs is decreased to a smaller diameter corresponding to the diameter of a petrol fuel nozzle. In this second position, the funnel tip is deformed to the size of a petrol fuel nozzle and thus will unlatch and open a sealing door in a mis-fueling inhibitor sized to receive a petrol fuel nozzle.

Figure 9:
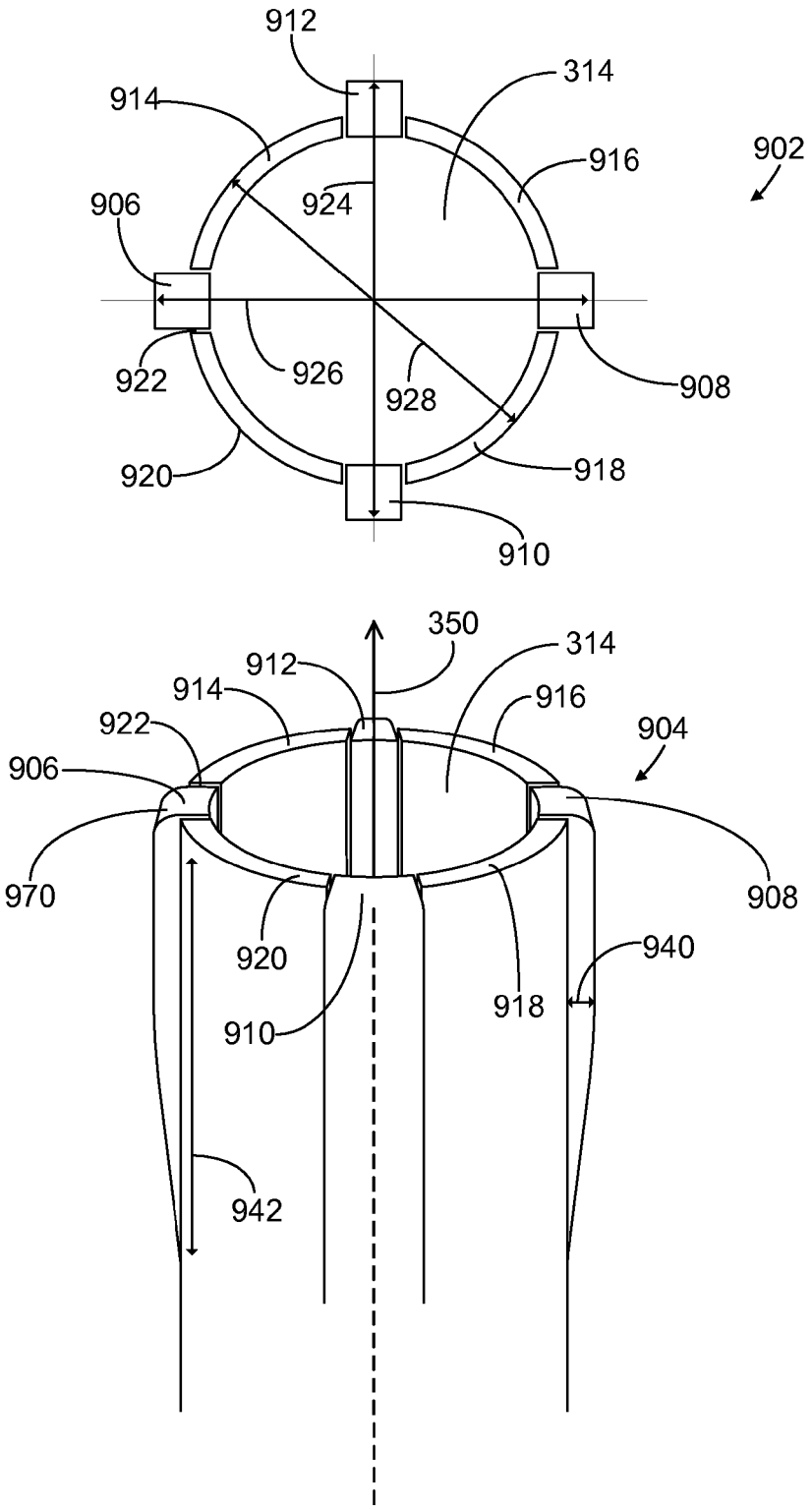

FIG. 9 shows another example tip of a universal refueling funnel from a point of view of second end 308 of funnel body 310 at 902 and from a top view (similar to the top views shown in FIG. 3) at 904. The example funnel tip shown in FIG. 9 corresponds to funnel configuration 612 shown at 610 in FIG. 6 described above.

In the example shown in FIG. 9, a cross section of second opening 314 is circular with a diameter 928 as measured from opposing outer walls of the funnel tip. The funnel tip includes two pairs of opposing tabs or fingers, a first opposing pair of tabs 906 and 908 and a second pair of opposing tabs 910 and 912. Further, the two pairs of opposing tabs may be orthogonal so that a line, e.g., line 926, extending between the outer walls of the opposing tabs 906 and 908 is perpendicular to a line, e.g., line 924, extending between the outer walls of opposing tabs 910 and 912.

A distance 926 from outer walls of the opposing tabs 906 and 908 is greater than the circular diameter 928 and distance 924 from outer walls of the opposing tabs 910 and 912 is also greater than the circular diameter 928. Distances 926 and 924 may be substantially the same length and may correspond to a diameter of an opening of a first type of mis-fueling inhibitor, e.g., a diesel mis-fueling inhibitor, whereas the circular diameter 928 corresponds to a diameter of an opening of a second type of mis-fueling inhibitor, e.g., a petrol mis-fueling inhibitor. For example, distances 926 and 924 may be the same length as a diameter of a standard size diesel fuel nozzle and circular diameter 928 may be the same length as a standard size petrol fuel nozzle.

The two pairs of opposing tabs may be separated from walls 914, 916, 918, and 920 of the funnel tip by thin gaps, e.g., gap 922, so that the two pairs of opposing tabs are movable relative to walls 914, 916, 918, and 920. The gaps separating the tabs from the walls of the tip may extend a distance 942 in a direction from the second opening 314 at second end 308 toward the enlarged first opening 312 along central axis 350 of the second opening 314. In this example, a width of the gaps separating the tabs from the walls of the funnel tip may be substantially constant throughout a length of the gap.

The opposing tabs may have a variety of shapes. For example, as shown in FIG. 9, outer edges 970 of the tabs adjacent to second end 308 at opening 314 may be rounded so that when the funnel tip is inserted into an orifice, the tabs will be pushed inward toward an interior of the funnel tip to decrease the distances 924 and 926 between outer walls of the opposing tabs. Further, the distance between outer walls of the opposing tabs may decrease in a direction from second end 308 at opening 314 towards the first end 306. For example, as shown in FIG. 9, the tabs may extend a distance 940 beyond the outer walls of funnel walls 914, 916, 918, and 920. This extension distance 940 may decrease to zero in a direction from second end 308 toward first end 306 along central axis 350 of second opening 314.

These flexible or deformable tabs in the funnel tip shown in FIG. 9 permit the funnel tip to deform into two different configurations with different diameters across the second opening so as to fit two differently sized mis-fueling inhibitors. For example, as described above with regard to FIG. 5, in a first extended position, the two pairs of opposing tabs remain in an open, extended position extending beyond walls 914, 916, 918, and 920 so that the distances 924 and 926 between outer walls of the opposing tabs are the same diameter as a diesel fuel nozzle and thus will unlatch and open a sealing door in a mis-fueling inhibitor sized to receive a diesel fuel nozzle. However, when inserted into a petrol mis-fueling inhibitor, tabs 906, 908, 910, and 912 will deform or bend towards an interior of the fuel funnel tip to a second position so that the distances 924 and 926 between outer walls of the opposing tabs are decreased to a smaller diameter corresponding to the diameter of a petrol fuel nozzle. In this second position, the funnel tip is deformed to the size of a petrol fuel nozzle and thus will unlatch and open a sealing door in a mis-fueling inhibitor sized to receive a petrol fuel nozzle.

Figure 10:
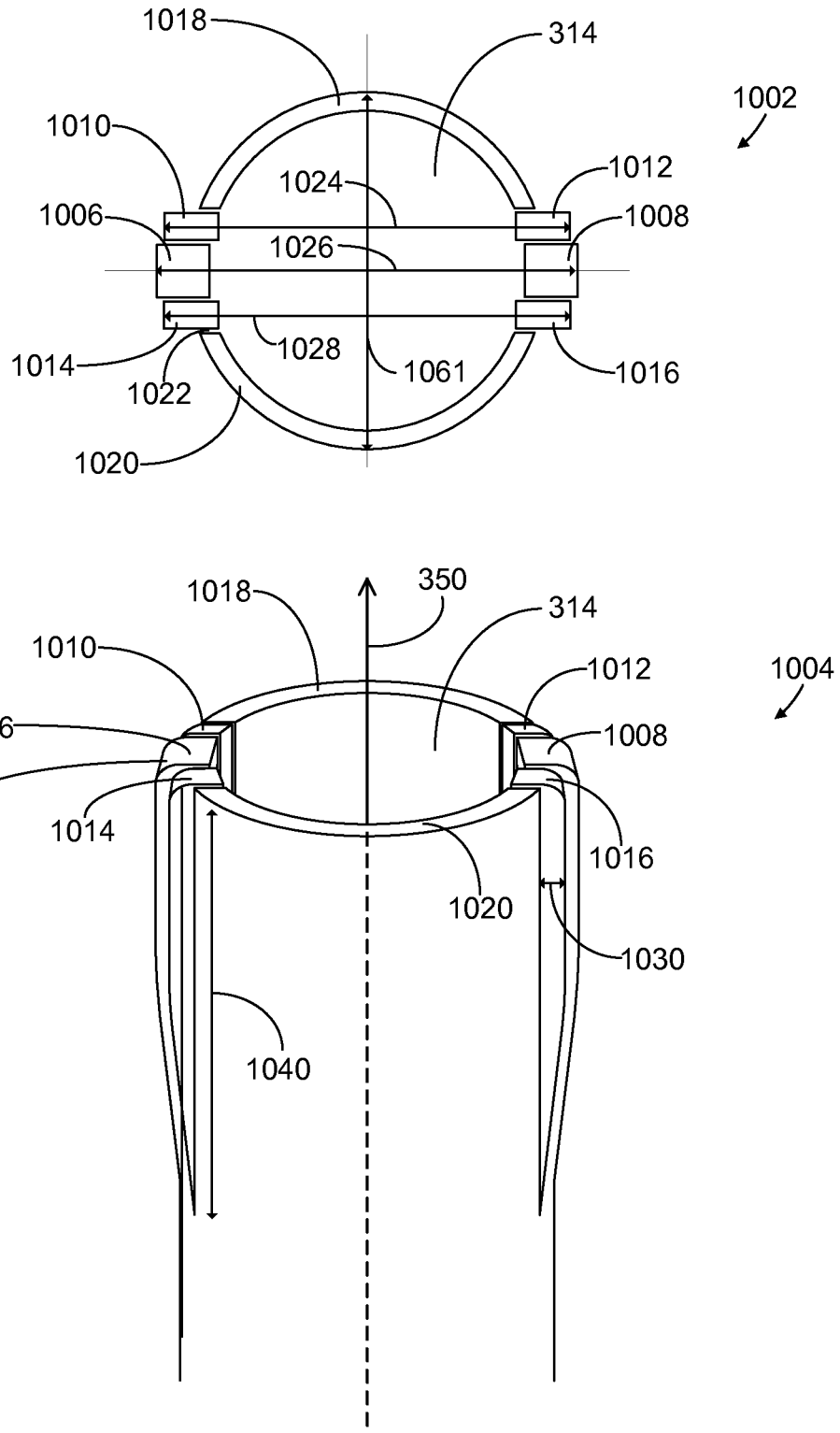

FIG. 10 shows yet another example tip of a universal refueling funnel from a point of view of second end 308 of funnel body 310 at 1002 and from a top view (similar to the top views shown in FIG. 3) at 1004. The example funnel tip shown in FIG. 10 corresponds to funnel configuration 616 shown at 614 in FIG. 6 described above.

In the example shown in FIG. 10, a cross section of second opening 314 is circular with a diameter 1061 as measured from opposing outer walls of the funnel tip. The funnel tip includes multiple pairs of opposing tabs or fingers: a first opposing pair of tabs 1006 and 1008, a second pair of opposing tabs 1010 and 1012, and a third pair of opposing tabs 1014 and 1016. The first pair of opposing tabs 1006 and 1008 may be flanked on one side by the second pair of opposing tabs 1010 and 1012 and on the other side by the third pair of opposing tabs 1014 and 1016.

A distance 1026 from outer walls of the first pair opposing tabs 1006 and 1008 is greater than the circular diameter 1061. A distance 1024 from outer walls of the second pair of opposing tabs 1010 and 1012 is also greater than the circular diameter 1061. A distance 1028 from outer walls of the third pair of opposing tabs 1014 and 1016 is also greater than the circular diameter 1061. Further, the distance 1026 from outer walls of the first pair of opposing tabs 1006 and 1008 is greater than both the distance 1024 from outer walls of the second pair of opposing tabs 1010 and 1012 and the distance 1028 from outer walls of the third pair of opposing tabs 1014 and 1016. Distances 1024 and 1028 may be substantially the same.

Distances 1028, 1026, and 1024 along the circumference of the funnel tip may be substantially the same length as corresponding diameters along a circumference of an opening of a first type of mis-fueling inhibitor, e.g., a diesel mis-fueling inhibitor, whereas the circular diameter 1061 corresponds to a diameter of an opening of a second type of mis-fueling inhibitor, e.g., a petrol mis-fueling inhibitor. For example, distances 1028, 1026, and 1024 along the circumference of the funnel tip may be the same length as corresponding diameters along a circumference of a standard size diesel fuel nozzle and circular diameter 928 may be the same length as a standard size petrol fuel nozzle.

The first pair of opposing tabs 1006 and 1008 may be separated from the pairs of opposing tabs flanking the first pair of opposing tabs by a thin gap. The side of the tabs in the second pair of opposing tabs 1010 and 1012 opposite the first pair of opposing tabs may be separated from funnel tip wall 1018 by a thin gap and the side of the tabs in the third pair of opposing tabs 1014 and 1016 opposite the first pair of opposing tabs may be separated from funnel tip wall 1020 by a thin gap. The gaps between flanking tabs and the funnel walls permit the tabs to be movable relative to other tabs and relative to the wall of the funnel tip. The gaps separating the tabs from the walls of the tip may extend a distance 1040 in a direction from the second opening 314 at second end 308 toward the enlarged first opening 312 along central axis 350 of the second opening 314. In this example, a width of a gap separating a tab from other tabs and/or the walls of the funnel tip may be substantially constant throughout a length of the gap.

The opposing tabs may have a variety of shapes. For example, as shown in FIG. 10, outer edges 1070 of the tabs adjacent to second end 308 at opening 314 may be rounded so that when the funnel tip is inserted into an orifice, the tabs will be pushed inward toward an interior of the funnel tip to decrease the distances 1024, 1026, and 1028 between outer walls of the opposing tabs. Further, the distance between outer walls of the opposing tabs may decrease in a direction from second end 308 at opening 314 towards the first end 306. For example, as shown in FIG. 10, a tab may extend a distance 1030 beyond the outer walls of funnel walls 1018 and 1020. This extension distance 1030 may decrease to zero in a direction from second end 308 toward first end 306 along central axis 350 of second opening 314.

These flexible or deformable tabs in the funnel tip shown in FIG. 10 permit the funnel tip to deform into two different configurations with different diameters across the second opening so as to fit two differently sized mis-fueling inhibitors. For example, as described above with regard to FIG. 5, in a first extended position, the three pairs of opposing tabs remain in an open, extended position extending beyond walls 1018 and 1020 so that the distances 1024, 1026, and 1028 between outer walls of the opposing tabs along the circumference of the funnel tip are the same length as corresponding diameters along a circumference of a diesel fuel nozzle and thus will unlatch and open a sealing door in a mis-fueling inhibitor sized to receive a diesel fuel nozzle. However, when inserted into a petrol mis-fueling inhibitor, tabs 1006, 1008, 1010, 1012, 1014, and 1016 will deform or bend towards an interior of the fuel funnel tip to a second position so that the distances 1024, 1026, and 1028 between outer walls of the opposing tabs along the circumference of the funnel tip are decreased to smaller diameters corresponding to diameters along a circumference of a petrol fuel nozzle. In this second position, the funnel tip is deformed to the size of a petrol fuel nozzle and thus will unlatch and open a sealing door in a mis-fueling inhibitor sized to receive a petrol fuel nozzle.

Figure 11:
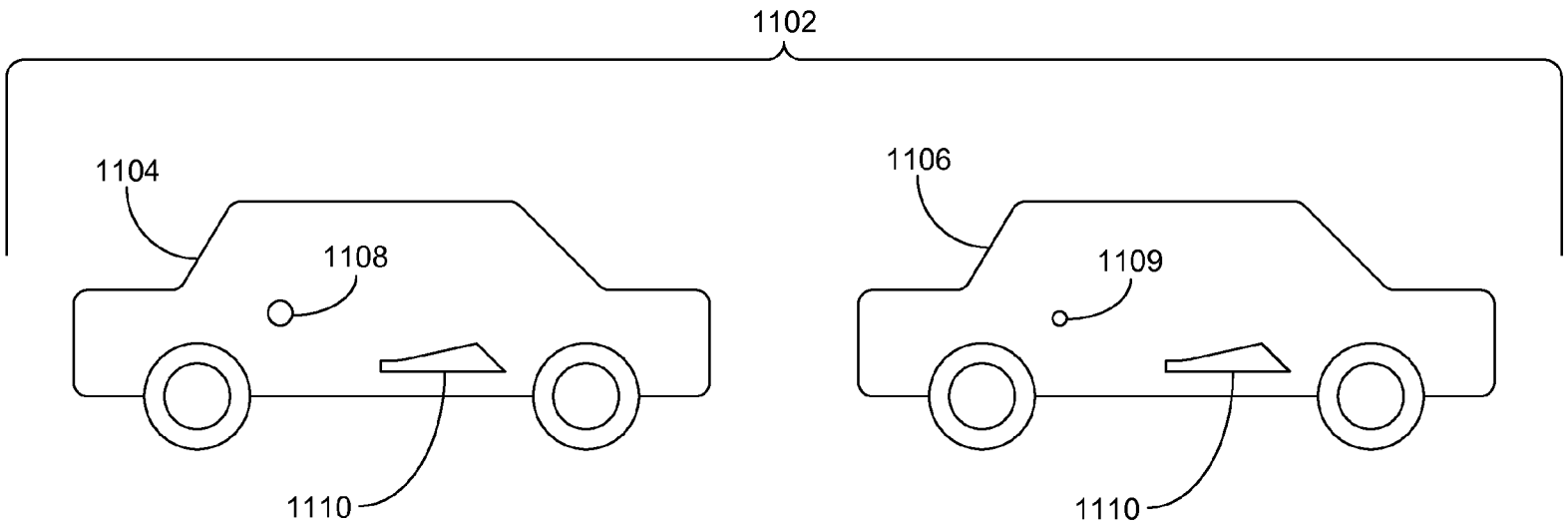
FIG. 11 shows an example line of vehicles including the same universal refueling adapter in accordance with the disclosure.

FIG. 11 shows an example line of vehicles 1102 including the same universal refueling adapter 1110. Line of vehicles 1102 may include at least a first vehicle 1104 and a second different vehicle 1106. Line of vehicles 1102 may include any number of at least two vehicles and may, for example, include partially assembled vehicles on an assembly line or assembled vehicles arranged together in a lot or other storage area.

First vehicle 1104 may include a refueling opening 1108 with a first size or diameter and second vehicle 1106 may include a refueling opening 1109 with a second, smaller size or diameter than the size or diameter of refueling opening 1108 in first vehicle 1104. For example, refueling opening 1108 may be a diesel mis-fueling inhibitor coupled to a capless refueling system of a diesel engine in vehicle 1104 and refueling opening 1109 may be a gasoline or petrol mis-fueling inhibitor coupled to a capless refueling system of a gasoline engine in vehicle 1106.

In this example, every vehicle in line of vehicles 1102 includes the same universal refueling funnel 1110. For example, the universal refueling funnel described above herein may be included in both first vehicle 1104 and second vehicle 1106. As described above, the universal refueling funnel included in each vehicle in a line of vehicles may be used to open differently sized mis-fueling inhibitors or to couple to differently sized refueling openings. For example, a common refueling funnel 1110 included each vehicle in line of vehicles 1102 may be coupled with both opening 1108 in vehicle 1104 and smaller opening 1109 in vehicle 1106 to assist in refueling. The common refueling funnel 1110 may be one of the above described funnels, such as in FIG. 3, for example. The common refueling funnel 1110 is exactly the same funnel in each of the first and second vehicle, for example having a common part number. Further, instructions may be provided in each of the respective first and second vehicles' owner manual, which may be electronically stored or on paper, for example. The instructions may explain how to utilize the common refueling funnel 1110 in each of a gasoline-fuelled vehicle and/or a diesel-fuelled vehicle.

It will be appreciated that the configurations disclosed herein are exemplary in nature, and that these specific embodiments are not to be considered in a limiting sense, because numerous variations are possible. For example, the above technology can be applied to V-6, I-4, I-6, V-12, opposed 4, and other engine types.

The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A capless refueling adapter, comprising:

a funnel body with a first opening at a first end and a second opening at a second end opposing the first end and comprising a tip which couples to a capless refueling system, the first opening larger than the second opening, and cross-sections of the funnel body decreasing from the first end towards the second end; and at least two opposing tabs extending integrally on the tip for a distance along the tip at the second end, the opposing tabs deformable from a first position to a second position, a distance between outer surfaces of the opposing tabs at the second end being a first amount in the first position, the distance being a second, smaller amount, in the second position, wherein in the second position the opposing tabs are folded into an interior of the tip;

wherein the first distance is substantially the same length as a diameter of a standard diesel fuel nozzle and the second distance is substantially the same length as a diameter of a standard petrol fuel nozzle, such that the tip opens a sealing door of a standard petrol misfuelling inhibitor and a sealing door of a standard diesel misfuelling inhibitor, and wherein a length of each of the tabs in a direction from the first opening to the second opening is configured such that an upper end of the respective tab is inside the respective misfuelling inhibitor when the respective sealing door is opened.

2. The adapter of claim 1, wherein the distance between outer surfaces of the opposing tabs decreases in a direction from the second end toward the first end.

3. The adapter of claim 1, wherein the funnel body is composed of a plastic.

4. The adapter of claim 1, wherein the funnel body has only elliptical cross-sections throughout the body.

5. The adapter of claim 1, wherein the first opening is angled into the funnel body.

6. The adapter of claim 1, wherein at the second end of the funnel body, the funnel body comprises a plurality of walls, each opposing tab flanked by two walls of the plurality of walls, and wherein each wall flanking each opposing tab is separated from that opposing tab by a gap.

7. The adapter of claim 1, wherein the at least two opposing tabs at the second end comprise two pairs of opposing tabs, wherein the distance between outer surfaces of each pair of opposing tabs is greater than a diameter of the second opening.

8. The adapter of claim 1, wherein the at least two opposing tabs at the second end comprise a first pair of opposing tabs flanked by a second and third pair of opposing tabs, wherein the distance between outer surfaces of each pair of opposing tabs is greater than a diameter of the second opening.

9. A capless refueling funnel, comprising:

a funnel body with a funnel portion and a tip, cross sections of the funnel portion being only elliptical with decreasing diameters in a direction from the funnel portion to the tip;

at least two opposing deformable tabs at an opening in the tip, the tabs extending integrally on the tip for a distance along the tip, a distance between outer surfaces of the opposing tabs at the opening in the tip decreasing as the tabs are deformed inward, wherein the opposing tabs are deformable from a first position to a second position, the distance being a first amount in the first position, and the distance being a second, smaller, amount in the second position, wherein the distance between outer surfaces of the opposing tabs as measured at an axial position decreases as the axial position moves in a direction from the tip toward a funnel section, and wherein the distance in the second position is substantially the same length as a diameter of a central portion of the funnel;

wherein in the second position the opposing tabs are folded into an interior of the tip;

wherein the first amount is substantially the same length as a diameter of a standard diesel fuel nozzle and the second amount is substantially the same length as a diameter of a standard petrol fuel nozzle, such that the tip opens a sealing door of a standard petrol misfuelling inhibitor and a sealing door of a standard diesel misfuelling inhibitor; and wherein a length of each of the tabs in a direction from a first funnel opening to a second funnel opening is configured such that an upper end of the respective tab is inside the respective misfuelling inhibitor when the respective sealing door is opened.

10. The funnel of claim 9, further comprising a central section between the funnel section and the tip, wherein the central section has elliptical cross sections, and conjugate diameters of the elliptical cross sections of the funnel section decrease throughout the funnel section and the central section toward the tip, and wherein transverse diameters of elliptical cross sections of the funnel section decrease from the first funnel opening to the central section, and remain substantially constant throughout the central section, where the first funnel opening is at an end of the funnel section opposing the tip.

11. The funnel of claim 10, wherein the tip has elliptical cross sections and the transverse diameters of the elliptical cross sections in the tip increase from the central section to the opening at the tip and the conjugate diameters of the elliptical cross sections in the tip remain substantially the same as the constant conjugate cross sections in the central portion.

12. The funnel of claim 9, wherein the first funnel opening is at an end of the funnel section opposing the tip, wherein the first funnel opening is angled relative to a central axis of the funnel.

13. The funnel of claim 9, wherein at the tip of the funnel body, the funnel body comprises a plurality of walls, each opposing tab flanked by two walls of the plurality of walls, and wherein each wall flanking each opposing tab is separated from that opposing tab by a gap.

14. The funnel of claim 9, wherein the at least two opposing tabs at a second end comprise a plurality of pairs of opposing tabs, wherein the distance between outer surfaces of each pair of opposing tabs at the opening in the tip is greater than a diameter of the opening in the tip.

15. A system, comprising:

a capless refueling funnel, including:

a funnel body with a funnel portion, a tip, and a central portion between the funnel portion and the tip, where cross sections of the funnel portion and central portion are elliptical, wherein conjugate diameters of the elliptical cross sections of the funnel portion and central portion decrease throughout the funnel portion and the central portion toward the tip, and wherein transverse diameters of elliptical cross sections of the funnel portion decrease from an opening at an end of the funnel portion opposing the tip to the central portion and remain substantially constant throughout the central portion; and at least two opposing tabs extending from an opening in the tip toward the central portion, wherein the opposing tabs are deformable from a first position to a second position, wherein in the first position a distance between outer surfaces of the opposing tabs at the opening in the tip is a first distance, and wherein in the second position a distance between outer surfaces of the opposing tabs at the opening in the tip is a second distance less than the first distance, and wherein the first distance is a transverse diameter of an elliptical cross section of the tip and the second distance is a conjugate diameter of the elliptical cross section of the tip, wherein the transverse diameter is greater than the conjugate diameter; and human readable vehicle operating instructions for refueling a vehicle with the refueling funnel;

wherein in the second position the opposing tabs are folded into an interior of the tip;

wherein the first distance is substantially the same length as a diameter of a standard diesel fuel nozzle and the second distance is substantially the same length as a diameter of a standard petrol fuel nozzle, such that the tip opens a sealing door of a standard petrol misfuelling inhibitor and a sealing door of a standard diesel misfuelling inhibitor; and wherein a length of each of the tabs in a direction from a first funnel opening to a second funnel opening is configured such that an upper end of the respective tab is inside the respective misfuelling inhibitor when the respective sealing door is opened.

16. A line of vehicles, comprising:

a first vehicle with a first refueling opening;

a second vehicle with a second refueling opening smaller than the first refueling opening; and a common refueling funnel included in each of the first vehicle and the second vehicle having a deformable opening end tip, the tip comprising deformable tabs extending along a distance of the tip, for mating with each of the first and second openings, wherein the funnel rigidly adapts to configure to the first and second openings;

wherein the deformable tabs are foldable into an interior of the tip;

wherein the first opening is substantially the same size as a diameter of a standard diesel fuel nozzle and the second opening is substantially the same size as a diameter of a standard petrol fuel nozzle, such that the tip opens a sealing door of a standard petrol misfuelling inhibitor and a sealing door of a standard diesel misfuelling inhibitor; and wherein a length of each of the tabs in a direction from a first funnel opening to a second funnel opening is configured such that an upper end of the respective tab is inside the respective misfuelling inhibitor when the respective sealing door is opened.

17. The funnel of claim 9, further comprising gaps separating the opposing tabs, wherein the gaps each include a thin wall extending therethrough where a width of the thin wall is less than a width of the tabs.

18. The funnel of claim 9, further comprising gaps between the opposing tabs which are at least partially closed in the second position.

* * * * *